US010892074B2

(12) United States Patent
Abe et al.

(10) Patent No.: US 10,892,074 B2
(45) Date of Patent: Jan. 12, 2021

(54) METHOD FOR MANUFACTURING RESISTOR

(71) Applicant: KOA CORPORATION, Ina (JP)

(72) Inventors: Yuichi Abe, Ina (JP); Seiji Karasawa, Ina (JP); Michio Kubota, Ina (JP); Yoji Gomi, Ina (JP); Koichi Minowa, Ina (JP)

(73) Assignee: KOA CORPORATION, Ina (JP)

( * ) Notice: Subject to any disclaimer, the term of this patent is extended or adjusted under 35 U.S.C. 154(b) by 0 days.

(21) Appl. No.: 16/771,334

(22) PCT Filed: Dec. 11, 2018

(86) PCT No.: PCT/JP2018/045457
§ 371 (c)(1),
(2) Date: Jun. 10, 2020

(87) PCT Pub. No.: WO2019/117128
PCT Pub. Date: Jun. 20, 2019

(65) Prior Publication Data

US 2020/0343028 A1 Oct. 29, 2020

(30) Foreign Application Priority Data

Dec. 12, 2017 (JP) ..... 2017-237821

(51) Int. Cl.
*H01C 17/28* (2006.01)

(52) U.S. Cl.
CPC ..... *H01C 17/281* (2013.01)

(58) Field of Classification Search
CPC ..... H01C 17/281; H01C 13/00; H01C 7/003; H01C 1/02
See application file for complete search history.

(56) References Cited

U.S. PATENT DOCUMENTS 5,179,366 A * 1/1993 Wagner ..... H01C 17/006 338/313
5,563,572 A * 10/1996 Hetzler ..... H01C 13/02 338/254

(Continued)

FOREIGN PATENT DOCUMENTS

JP 53-14133 U 2/1978
JP 59-177929 U 11/1984

(Continued)

OTHER PUBLICATIONS

Decision to Grant a Patent dated Jul. 16, 2019, issued in counterpart JP application No. 2017-237821, with English translation (5 pages).

(Continued)

*Primary Examiner* — Kyung S Lee
(74) *Attorney, Agent, or Firm* — Westerman, Hattori, Daniels & Adrian, LLP

(57) ABSTRACT

An object is to provide a method for manufacturing a resistor capable of suppressing variations in the thickness of a thermally conductive layer interposed between a resistive body and electrode plates. The method for manufacturing a resistor according to the present invention includes a step of forming an unhardened thermally conductive layer on a surface of a resistive body, a step of bringing the thermally conductive layer into a semi-hardened state, and a step of bending electrode plates respectively disposed at both sides of the resistive body, further hardening the thermally conductive layer, and performing adhesion between the resistive body and the electrode plates via the thermally conductive layer.

2 Claims, 6 Drawing Sheets

(56) References Cited

U.S. PATENT DOCUMENTS

| | | | | |
|---|---|---|---|---|
| 5,739,743 | A * | 4/1998 | Mazzochette | H05K 3/3442 338/313 |
| 6,558,783 | B1 | 5/2003 | Kato et al. | |
| 7,190,252 | B2 | 3/2007 | Smith et al. | |
| 8,325,007 | B2 * | 12/2012 | Smith | H01C 1/14 338/328 |
| 8,823,483 | B2 * | 9/2014 | Smith | H01C 1/084 338/332 |
| 9,728,306 | B2 * | 8/2017 | Lu | H01C 1/028 |
| 10,438,729 | B2 * | 10/2019 | Wyatt | H01C 1/084 |
| 2004/0156177 | A1 | 8/2004 | Higashitani | |
| 2006/0197648 | A1 | 9/2006 | Smith et al. | |
| 2008/0180210 | A1 * | 7/2008 | Ikeda | H05B 3/14 338/22 R |
| 2009/0224865 | A1 | 9/2009 | Tanaka et al. | |
| 2015/0194553 | A1 * | 7/2015 | Wang | B32B 27/308 136/259 |
| 2016/0222256 | A1 * | 8/2016 | Kato | C09J 9/02 |

FOREIGN PATENT DOCUMENTS

| | | | |
|---|---|---|---|
| JP | 9-181448 | A | 7/1997 |
| JP | 11-162721 | A | 6/1999 |
| JP | 2004-128000 | A | 4/2004 |
| JP | 2008-532280 | A | 8/2008 |
| JP | 4806421 | B2 | 11/2011 |
| JP | 2015-8316 | A | 1/2015 |

OTHER PUBLICATIONS

Notice of Reasons for Refusal dated Feb. 26, 2019, issued in counterpart JP application No. 2017-237821, with English translation (8 pages).

International Search Report dated Mar. 5, 2019, issued in counterpart International Application No. PCT/JP2018/045457 (2 pages).

* cited by examiner

METHOD FOR MANUFACTURING RESISTOR

TECHNICAL FIELD

The present invention relates to a method for manufacturing a resistor.

BACKGROUND ART

Patent Literature 1 discloses an invention that relates to a resistor, and a method of manufacturing the resistor. The resistor disclosed in Patent Literature 1 includes a resistive body, electrode plates which are positioned at both sides of the resistive body, respectively, and bent toward the lower surface side of the resistive body, and an electrically non-conductive filler interposed between the resistive body and the electrode plates.

The filler serves to adhere the resistive body to the electrode plates. In the resistor as disclosed in Patent Literature 1, heat is conducted from the resistive body to the electrode plates via the filler to obtain a reliable heat dissipation capability.

CITATION LIST

Patent Literature

Patent Literature 1: Japanese Patent No. 4806421

SUMMARY OF INVENTION

Technical Problem

In Patent Literature 1, the filler in an uncured and unsolidified state is disposed on the surface of the resistive body, and the electrode plates are bent into contact with the filler. Thereafter, the filler is cured and solidified.

In Patent Literature 1, the filler remains uncured, and therefore exhibits a high fluidity where the filler comes into contact with the bent electrode plates. The high fluidity of the filler is likely to cause variations in thickness of the filler between the resistive body and the electrode plates. Accordingly, the resistor disclosed in Patent Literature 1 has a problem in that the heat dissipation property and adhesive strength are likely to vary.

The present invention has been made in consideration of the above-described problem. In particular, it is an object of the present invention to provide a method for manufacturing a resistor, which is capable of suppressing thickness variations of the thermally conductive layer interposed between the resistive body and the electrode plates.

Solution to Problem

A method for manufacturing a resistor according to the present invention includes a step of forming an unhardened (uncured) thermally conductive layer on a surface of a resistive body, a step of bringing the thermally conductive layer into a semi-hardened (semi-cured) state, and a step of bending electrode plates respectively disposed at both sides of the resistive body, further hardening (curing) the thermally conductive layer, and performing adhesion between the resistive body and the electrode plates via the thermally conductive layer.

Advantageous Effect of Invention

Compared to a background art method, a method for manufacturing a resistor according to the present invention ensures that variations in thickness of a thermally conductive layer between a resistive body and electrode plates are suppressed. The method allows for manufacturing a resistor with reduced variations in the heat dissipation property and the adhesive strength.

DESCRIPTION OF EMBODIMENT

Figure 1A:
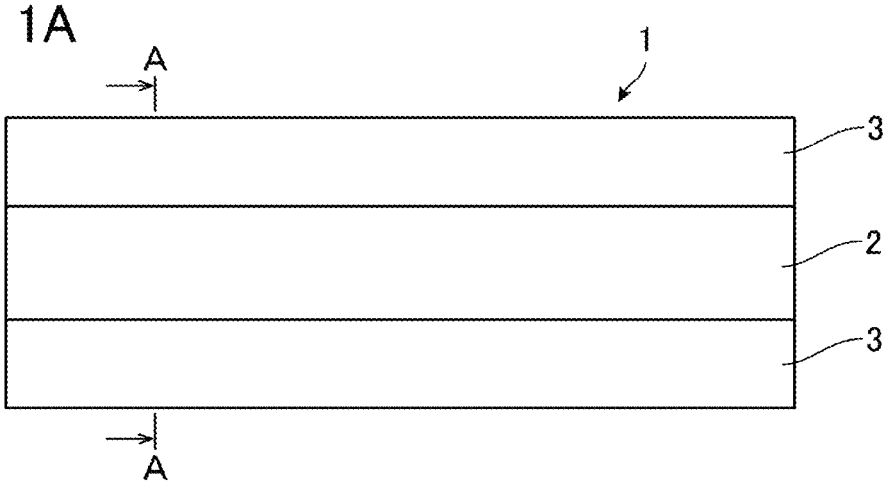
FIG. 1A is a plan view describing a step for manufacturing a resistor according to an embodiment of the present invention.

An embodiment according to the present invention (hereinafter simply referred to as an "embodiment") will be described in detail. The present invention is not limited to the embodiment described below, but may be implemented in various modifications within the scope of the present invention.

(Method for Manufacturing a Resistor)

Referring to the drawings, individual steps included in the method for manufacturing a resistor are described in the order they are performed.

Figure 1B:
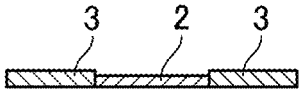
FIG. 1B is a sectional view taken along line A-A of FIG. 1A as seen from an arrow direction.

In the step depicted in FIGS. 1A and 1B, a resistive body 2 and a plurality of electrode plates 3 are prepared. Each of the resistive body 2 and the electrode plates 3 has a flat plate shape or a belt-like shape. In the embodiment depicted in FIG. 1A, each of the resistive body 2 and the electrode plates 3 has a belt-like shape.

In the step depicted in FIGS. 1A and 1B, the electrode plates 3 are bonded to opposite sides of the resistive body 2 through laser welding, for example, to produce a bonded body 1. The laser welding is a non-limiting example and any existing process may be used for the bonding. As depicted in FIG. 1A, the bonded body 1 may be formed in a belt-like shape by bonding the resistive body 2 and the electrode plates 3. The bonded body 1 may be wound into a roll, and placed on a production line to enable automatic execution of the subsequent manufacturing steps for mass-production of the resistors according to the embodiment.

In the embodiment, the thickness of each of the resistive body 2 and the electrode plate 3 is not limited. For example, the resistive body 2 may be formed to have a thickness ranging from several tens of μm to several hundreds of μm approximately. The resistive body 2 may have either substantially the same thickness as, or a different thickness from, that of the electrode plate 3.

In the embodiment, existing material may be used for forming the resistive body 2 and the electrode plate 3 in a non-restrictive manner. For example, it is possible to use a metallic resistance material, such as copper-nickel and nickel-chrome, a structure formed by applying a metal film onto the surface of an insulating base, a conductive ceramic substrate, and the like for forming the resistive body 2. For example, it is possible to use copper, silver, nickel, chrome, and composite material thereof for forming the electrode plate 3.

When bonding the electrode plates 3 to both sides of the resistive body 2, each end surface of the resistive body 2 may be brought into abutment on the corresponding end surface of the electrode plates 3, as shown in FIG. 1B. Alternatively, the resistive body 2 and the electrode plates 3 may be bonded while having the respective surfaces partially overlapped with each other.

The resistive body 2 and the electrode plates 3 may be integrally formed. That is, it is possible to use a single metal resistance plate as the material for forming both the resistive body 2 and the electrode plates 3. Alternatively, instead, those portions of a metal resistance plate which serve as electrode plates 3 may be coated, for example, by plating with a low-resistance metallic material, so as to obtain the electrode plate 3 on the plated surface of the metal resistance plate.

Figure 2A:
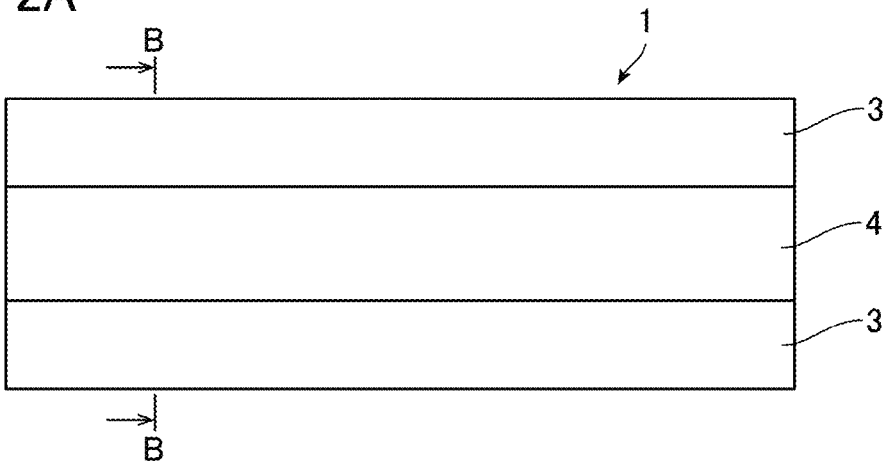
FIG. 2A is a plan view describing a manufacturing step subsequent to the step described in FIG. 1A.

Subsequently, in the step depicted in FIGS. 2A and 2B, an unhardened (uncured) thermally conductive layer 4 is formed on the surface of the resistive body 2. Preferably, the thermally conductive layer 4 is an electrically insulating thermosetting resin with high thermal conductivity. For example, a thermosetting resin such as epoxy and polyimide may be used for forming the thermally conductive layer 4.

The unhardened (uncured) thermally conductive layer 4 may be in the form of a film or a paste. In the case of the film, the unhardened (uncured) thermally conductive resin film is adhered onto the surface of the resistive body 2. In the case of the paste, the unhardened (uncured) thermally conductive resin paste is applied to or printed on the surface of the resistive body 2. Alternatively, the thermally conductive layer 4 may be formed by inkjet process.

In the embodiment, the thickness of the thermally conductive layer 4 is not limited, and may be determined considering the thermal conductivity of the resistor as a finished product, and secure fixation between the resistive body and the electrode plates. For example, preferably, the thickness of the thermally conductive layer 4 is in the range from approximately 10 μm to 200 μm.

As used herein, the term "unhardened (uncured)" refers to the state where the layer is not completely hardened or cured. Specifically, the unhardened (uncured) state represents a state where curing reaction has hardly proceeded such that the thermally conductive layer retains substantially the same fluidity as that exhibited upon initial formation, or in the case of obtaining a thermally conductive layer as a pre-manufactured, purchased product, the unhardened (uncured) state represents the state of the product as shipped where the thermally conductive layer is not completely hardened or cured. The term "hardened (completely hardened)" or "cured (completely cured)" refers to the state where the layer has lost the fluidity owing to polymerization that proceeds by linkage of molecules. For example, where the thermally conductive layer 4 is formed as a thermally conductive resin film, pre-processing (temporary pressure-bonding) is performed after placing the thermally conductive layer 4 on the resistive body 2 as shown in FIG. 2B. In this case, the state after performing the pre-processing is defined as the "unhardened (uncured)" state. That is, during the pre-processing, heat (equal to or lower than the application temperature) is applied for a short period of time (for example, approximately several minutes) to adhere (temporarily pressure-bond) the thermally conductive layer 4 to the resistive body 2. The thermally conductive layer 4 after heating in the pre-processing is still in the "unhardened (uncured)" state.

When using a thermally conductive resin film for the thermally conductive layer 4, the thermally conductive layer 4 is in the unhardened and solidified state. The term "solidified" refers to the state of having become solid.

Meanwhile, when using a thermally conductive resin paste for the thermally conductive layer 4, the thermally conductive layer 4 is in the unhardened (uncured) and unsolidified state. The term "unsolidified" refers to the state where the solid component is partially or entirely dispersed in the solvent, and may include the state or material such as a slurry or ink.

Figure 2B:
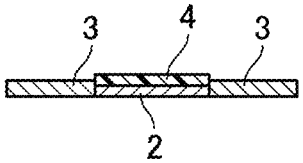
FIG. 2B is a sectional view taken along line B-B of FIG. 2A as seen from an arrow direction.
Figure 2C:
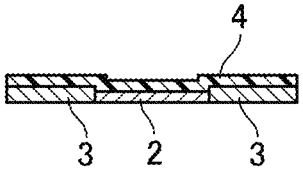
FIG. 2C is a sectional view of a structure that is different from the one described in FIG. 2B.

In the embodiment, the thermally conductive layer 4 may be formed only on the surface of the resistive body 2, as shown in FIG. 2B. Alternatively, instead, it is possible to form the thermally conductive layer 4 across the surfaces of the resistive body 2 and the electrode plates 3, as shown in FIG. 2C. Still alternatively, while not illustrated in the drawings, it is possible to form the thermally conductive layer 4 on the surface of the resistive body 2 and only adjoining parts of the surfaces of the electrode plates 3. Yet still alternatively, it is possible to form the thermally conductive layer 4 on a region except bent parts formed where the electrode plates 3 are bent in a subsequent step of manufacture, described later. That is, the thermally conductive layer 4 may be formed in three divided parts on the respective surfaces of the resistive body 2 and the electrode plates 3 except the boundary between the resistive body 2 and each electrode plate 3.

Forming the thermally conductive layer 4 not only on the surface of the resistive body 2 but also on the surfaces of the electrode plates 3 as depicted in FIG. 2C makes it possible to facilitate formation of the thermally conductive layer 4. Specifically, for example, when using a thermally conductive resin film for the thermally conductive layer 4, the thermally conductive resin film does not have to be positioned relative to the resistive body 2, but rather, a thermally conductive resin film that is large enough to cover the resistive body 2 and the electrode plates 3 may be stuck on the surfaces of the resistive body 2 and the electrode plates 3, as depicted in FIG. 2C. Alternatively, when using a thermally conductive resin paste for the thermally conductive layer 4, the thermally conductive layer 4 may be applied throughout the surfaces of the resistive body 2 and the electrode plates 3. Hence, the manufacturing step may be simplified by forming the thermally conductive layer 4 not only on the surface of the resistive body 2 but also on the surfaces of the electrode plates 3.

Thereafter, the unhardened thermally conductive layer 4 is heated into a semi-hardened (semi-cured) state. The term "semi-hardened (semi-cured)" refers to an intermediate hardened state that occurs between the "unhardened (uncured)" state and the "completely hardened (cured)" state. Determination as to whether or not the layer is in the semi-hardened (semi-cured) state may be made in accordance with the degree of cure (hardness), viscosity, thermal processing conditions or the like. It is possible to use a degree of cure calculated from the calorific value derived from the measurement utilizing the differential scanning calorimeter, for example. The semi-hardened (semi-cured) state represents a transition state in which hardening or curing has proceeded further from the previous state (i.e., the unhardened state, or the state before the heating process for semi-curing) but only to the extent that further hardening or curing is possible. As such, where the semi-hardened (semi-cured) state is determined based on the degree of cure, a state in which the degree of cure has become higher than the one in the previous state may be included in the semi-hardened state. As a non-limiting example, the semi-hardened (semi-cured) state may represent a state in which the degree of cure is in the range from 5% to 70%, or a state generally called "B stage". Moreover, determination as to whether or not the layer is in the "completely hardened (cured) state" may be made in accordance with the degree of cure, the thermal processing condition or the like. It is possible to use the degree of cure (hardness) calculated from the calorific value derived from the measurement utilizing the differential scanning calorimeter. Complete hardening (curing) refers to a state where the degree of cure is equal to or higher than 70%, or a state generally called "C stage".

As the unhardened (uncured) thermally conductive layer 4 is brought into the semi-hardened state as described above, the fluidity of the thermally conductive layer 4 may be lowered.

Although the thermal processing condition for semi-hardening (semi-curing) the thermally conductive layer 4 is not limited in the embodiment, it is preferable to apply heat to the thermally conductive layer 4 at the application temperature ranging from approximately 100° C. to 250° C. for approximately 5 to 60 minutes. For example, the same application temperature of the complete hardening (curing) condition and the application time approximately 10% to 50% of the one set for complete hardening (curing) may be used for semi-hardening (semi-curing). The application temperature and the application time required for hardening (curing) vary depending on the material for forming the thermally conductive layer 4. Therefore, if the thermally conductive layer 4 is a pre-manufactured, purchased product, the thermal processing may be performed in accordance with the application temperature and the application time as prescribed by the manufacturer.

Figure 3A:
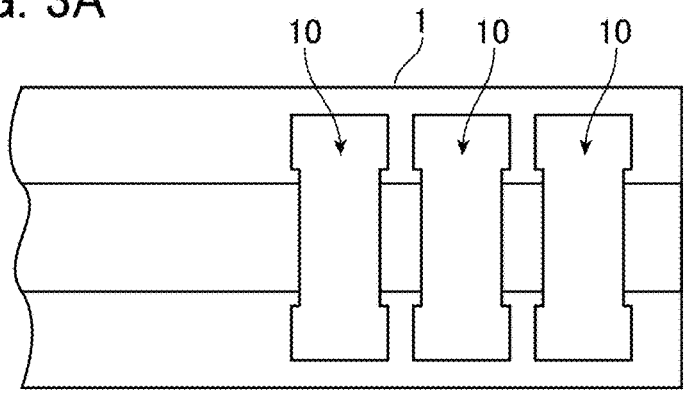
FIG. 3A is a plan view describing a manufacturing step subsequent to the step depicted in FIGS. 2A and 2B.
Figure 3B:
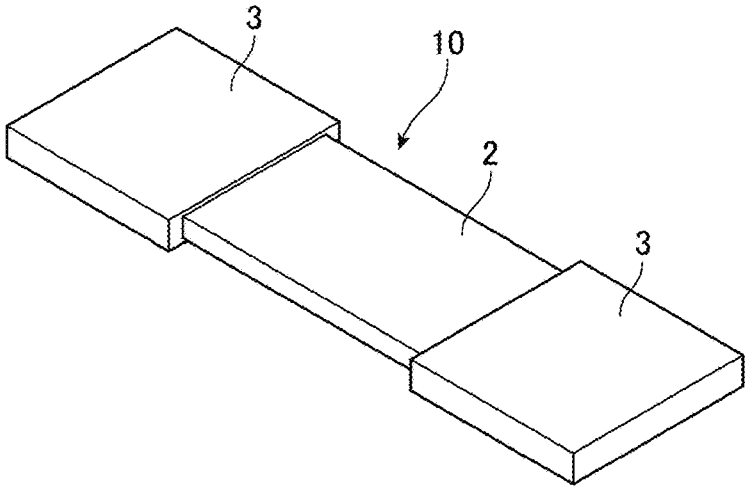
FIG. 3B is a perspective view of a resistor intermediate cut in the step depicted in FIG. 3A.

A resistor intermediate 10 is cut out from the bonded body 1 having the semi-hardened (semi-cured) thermally conductive layer 4, as depicted in FIG. 3A. FIG. 3B is a perspective view of the cut-out resistor intermediate 10.

As the belt-like bonded body 1 depicted in FIG. 3A is longitudinally fed, a plurality of resistor intermediates 10 may be continuously cut out with a press machine along the longitudinal direction. Thus, mass-production may be realized with a large number of resistor intermediates 10 obtained in a short period of time.

The resistor intermediate 10 comprises the resistive body 2 having a rectangular outer shape, and the pair of electrode plates 3 each having a rectangular outer shape provided at the respective opposite sides of the resistive body 2. The outer shape of the resistor intermediate 10 depicted in FIG. 3B is a mere example. It is therefore possible to form the resistor intermediate 10 to have an outer shape other than the one depicted in FIG. 3B.

Figure 4:
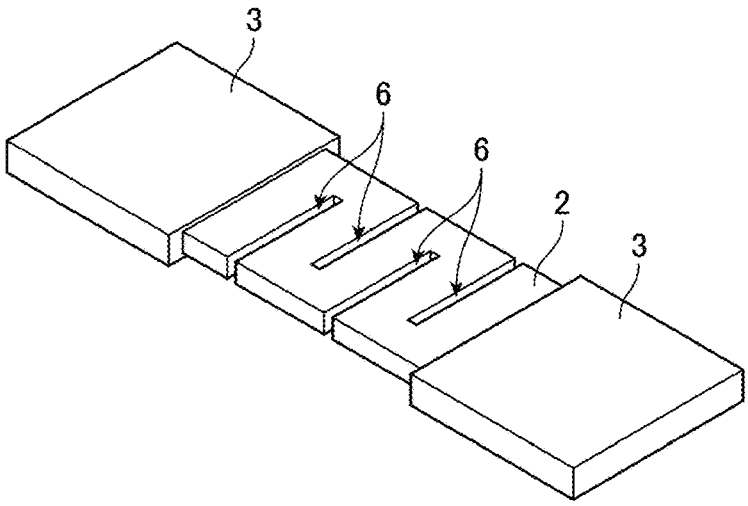
FIG. 4 is a perspective view describing a manufacturing step subsequent to the step depicted in FIG. 3B.

Subsequently, in the step depicted in FIG. 4, a plurality of cut portions 6 are formed in the resistive body 2 so that a meander pattern is formed for adjusting the resistance. The length, the position, and the number of the cut portions 6 may be appropriately adjusted so that the resistive body 2 has a predetermined resistance value. The step depicted in FIG. 4 may be performed as needed.

Figure 5A:
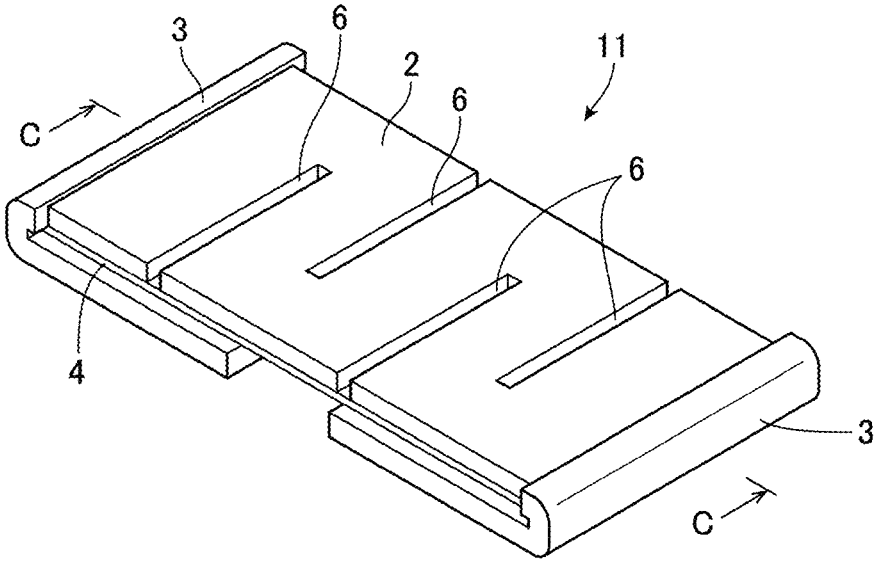
FIG. 5A is a perspective view describing a manufacturing step subsequent to the step depicted in FIG. 4.
Figure 5B:
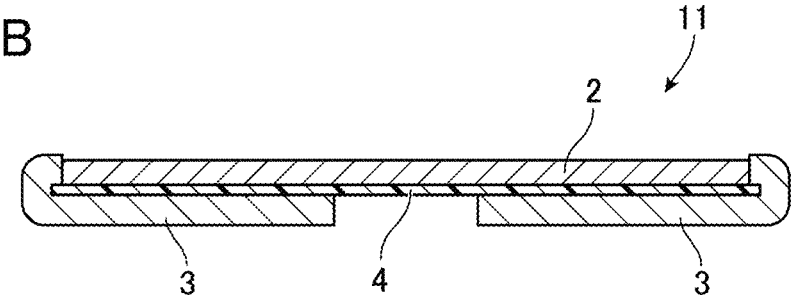
FIG. 5B is a sectional view taken along line C-C of FIG. 5A in a thickness direction as seen from an arrow direction.
Figure 5C:
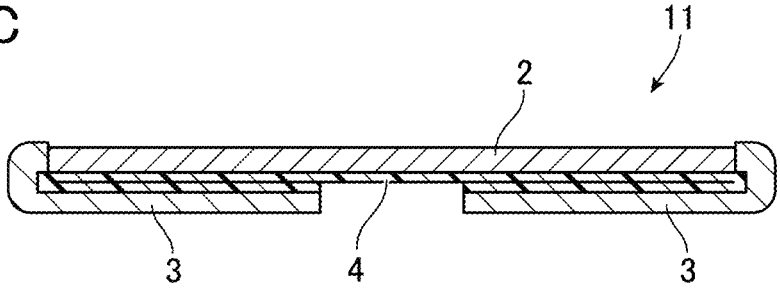
FIG. 5C is a sectional view of a structure formed using the resistor intermediate that has a laminated structure depicted in FIG. 2B.

Thereafter, the electrode plates 3 are bent toward the surface of the resistive body 2, on which the thermally conductive layer 4 is laminated, as depicted in FIG. 5A. In the example depicted in FIG. 5A, as the thermally conductive layer 4 is formed on the lower surface of the resistive body 2, the electrode plates 3 are bent downward toward the lower side. In FIGS. 5B and 5C, each of which schematically illustrates a cross section of the resistor 11 depicted in FIG. 5A, the cut portions 6 expected to appear in the resistive body 2 are not shown. Although the dimension ratios of the thickness and the length of the resistive body 2, the electrode plate 3 and the thermally conductive layer 4 as shown in FIGS. 2B and 2C are different from the ones as shown in FIGS. 5B and 5C, respectively, those drawings are exaggerated illustrations of the substantially same objects in which all dimensional ratios are maintained.

As depicted in FIGS. 5A and 5B, the bent electrode plates 3 face the lower side of the resistive body 2 via the thermally conductive layer 4. FIG. 5B depicts the structure formed by bending the electrode plates 3 of the resistor intermediate 10 that has the thermally conductive layer 4 only on the surface of the resistive body 2, as depicted in FIG. 2B. As such, the structure depicted in FIG. 5B has only a single thermally conductive layer 4 interposed between the resistive body 2 and the bent electrode plates 3.

Meanwhile, FIG. 5C depicts the structure formed by bending the electrode plates 3 of the resistor intermediate 10 that has the thermally conductive layer 4 covering the surfaces of both the resistive body 2 and the electrode plates 3, as depicted in FIG. 2C. As such, the structure depicted in FIG. 5C has two thermally conductive layers 4 interposed between the resistive body 2 and the bent electrode plates 3. In the example depicted in FIG. 5C, a single thermally conductive layer 4 is present at the center part of the resistive body 2 which the electrode plates 3 do not face.

The thermally conductive layer 4, which has remained in the semi-hardened state, is thereafter heated to be completely hardened or cured. For the definition of the term "complete hardening (complete curing)," refer to the explanation described earlier in the present application.

Although the thermal processing condition for completely hardening the thermally conductive layer 4 is not limited herein, it is preferable to apply heat to the thermally conductive layer 4 at the application temperature from approximately 150° C. to 250° C. for approximately 0.5 to 2 hours. The temperature and the time required for hardening vary depending on the material for forming the thermally conductive layer 4. The curing (hardening) condition for the thermally conductive layer 4 as a pre-manufactured, purchased product is specified in accordance with the temperature and the time as prescribed by the manufacturer. For example, for a resin used in experiments described herein-below, the application temperature may be adjusted as needed in a range from approximately 160° C. to 200° C., and the application time may be adjusted as needed in a range from approximately 70 minutes to 30 minutes (that is, the lower the application temperature is, the longer the application time is set).

In the embodiment, it is preferable to completely harden (cure) the thermally conductive layer 4 while pressing the bent electrode plates 3 toward the resistive body 2. That is, in the example depicted in FIG. 5B, the thermally conductive layer 4 is hardened (cured) by being heated under pressure while being in contact with the bent electrode plates 3. In the example depicted in FIG. 5C, the thermally conductive layer 4 positioned at the inner sides of the bent electrode plates 3 and the thermally conductive layer 4 on the lower surface of the resistive body 2 are completely hardened (cured) by being heated under pressure while the two thermally conductive layers 4 are superimposed one upon another. Such a procedure makes it possible to adhesively fix the resistive body 2 to the electrode plates 3 securely via the thermally conductive layer 4.

Figure 6A:
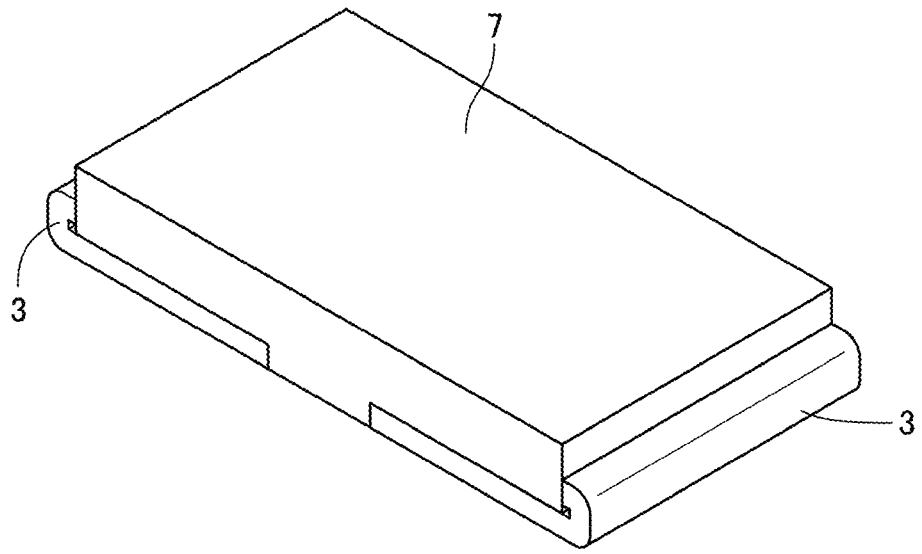
FIG. 6A is a perspective view describing a manufacturing step subsequent to the step depicted in FIG. 5A.
Figure 6B:
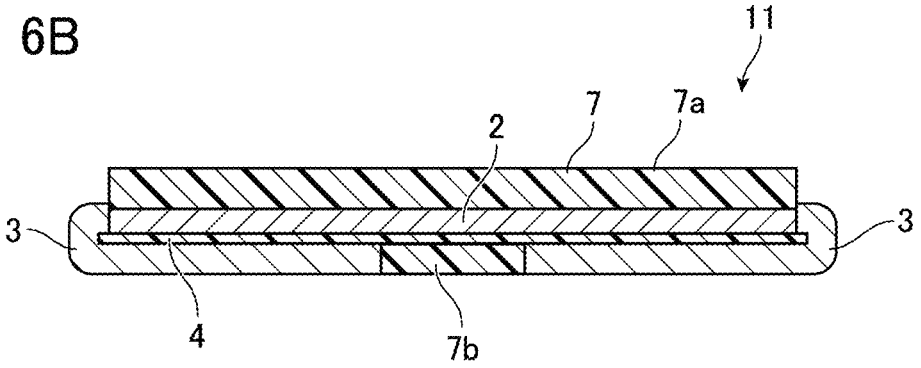
FIG. 6B is a sectional view describing a manufacturing step subsequent to the step depicted in FIG. 5B.
Figure 6C:
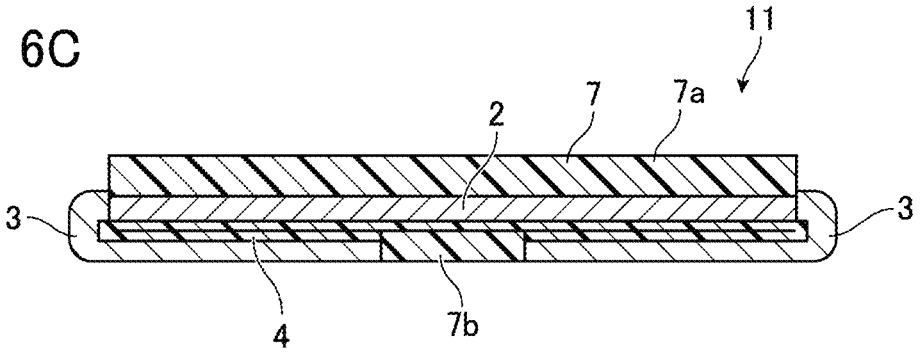
FIG. 6C is a sectional view describing a manufacturing step subsequent to the step depicted in FIG. 5C.

Then, in the step depicted in FIG. 6A, a protective layer 7 is mold-formed onto the surface of the resistive body 2. Preferably, the protective layer 7 is formed of a material with excellent heat resistance and electrical insulation properties. Although it is not intended to limit the material for forming the protective layer 7, the protective layer 7 may be mold-formed using a resin, glass, inorganic material and the like. As depicted in FIGS. 6B and 6C, the protective layer 7 includes a surface protective layer 7*a* for covering the surface of the resistive body 2, and a bottom surface protective layer 7*b* for filling the space between the bent electrode plates 3 at the lower surface side of the resistive body 2. As depicted in FIGS. 6B and 6C, the bottom surface protective layer 7*b* and the electrode plates 3 constitute a substantially flush bottom surface.

FIG. 6B depicts the step subsequent to the one depicted in FIG. 5B, and FIG. 6C depicts the step subsequent to the one depicted in FIG. 5C.

It is possible to provide a seal or stamping on the surface of the surface protective layer 7*a*.

Figure 7A:
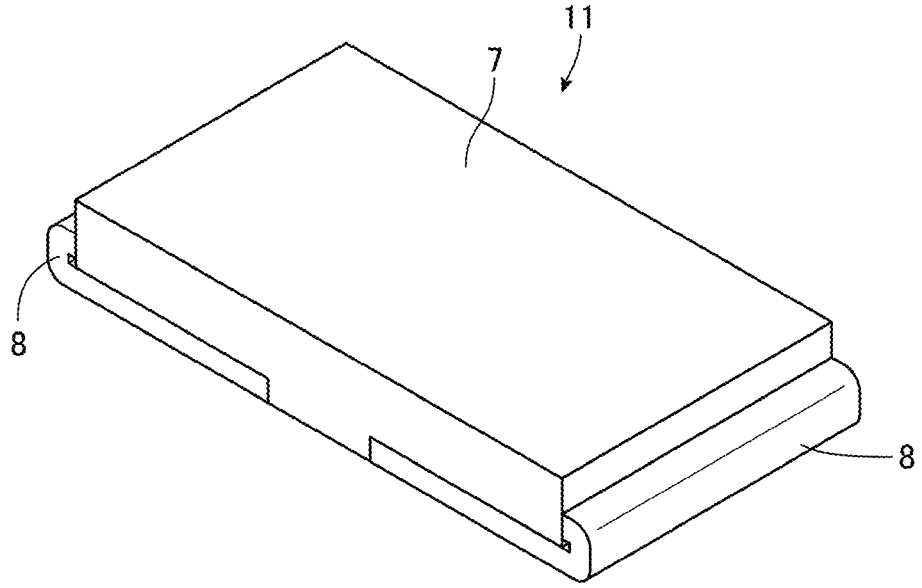
FIG. 7A is a perspective view describing a manufacturing step subsequent to the step depicted in FIG. 6A.
Figure 7B:
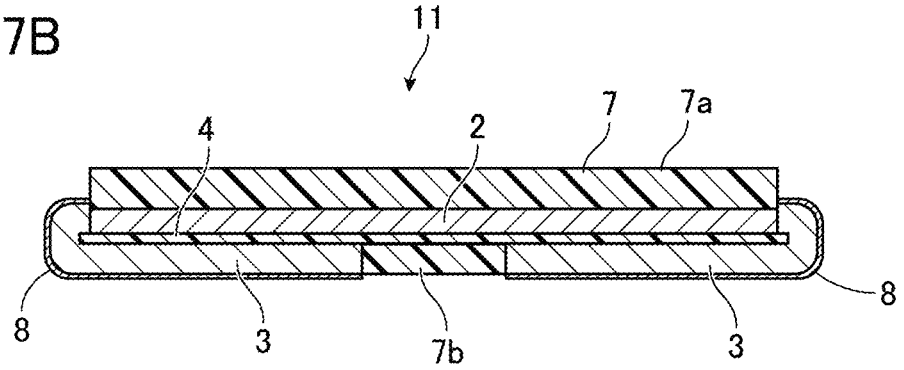
FIG. 7B is a sectional view describing a manufacturing step subsequent to the step depicted in FIG. 6B.
Figure 7C:
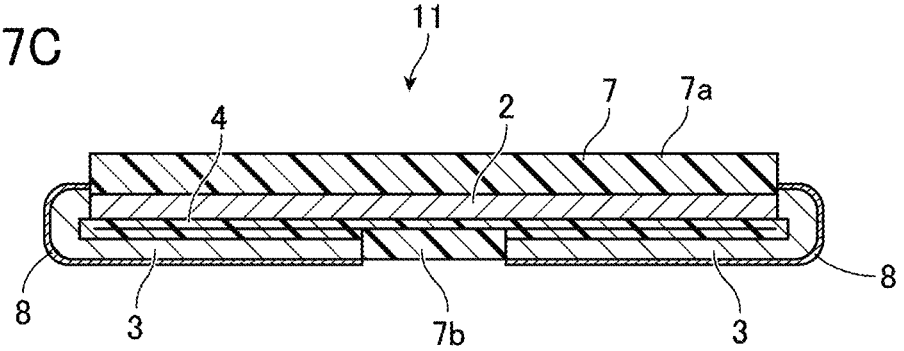
FIG. 7C is a sectional view describing a manufacturing step subsequent to the step depicted in FIG. 6C.

As depicted in FIGS. 7A, 7B, and 7C, plating is applied to surfaces of the electrode plates 3. Although the material for forming a plating layer 8 is not limited, the plating layer 8 may be formed of a Cu plating layer or an Ni plating layer, for example. The plating layer 8 serves to expand the contact area where the resistor 11 contacts a substrate surface on which the resistor 11 is disposed, and to suppress the soldering erosion of the electrode plate 3 upon soldering of the resistor 11 to the substrate surface. FIG. 7B represents the step subsequent to the one depicted in FIG. 6B. FIG. 7C represents the step subsequent to the one depicted in FIG. 6C. The plating process is carried out as needed.

(Resistor)

The resistor 11 manufactured through the above-described manufacturing steps includes the resistive body 2, the electrode plates 3 disposed at opposite, both sides of the resistive body 2 while being bent toward the lower surface side of the resistive body 2, and the hardened thermally conductive layer(s) 4 interposed between the resistive body 2 and the electrode plates 3, as depicted in FIGS. 7B and 7C.

The thermally conductive layer 4 interposed between the resistive body 2 and the electrode plates 3 has a thickness (which represents the total thickness of the double layers in the example depicted in FIG. 7C) ranging from approximately 50 μm to 150 μm. By adjusting the thickness of the thermally conductive layer 4 in this manner, it is possible to improve the heat dissipation from the resistive body 2 to the electrode plates 3 via the thermally conductive layer 4 appropriately. By adjusting the thickness of the thermally conductive layer 4 to be in the above-described range, it is possible to improve tightness of contact or adhesion between the resistive body 2 and the electrode plates 3, which in turn makes it possible to appropriately suppress occurrence of failures, such as peeling of the electrode plate 3 from the thermally conductive layer 4, and cracks generated in the thermally conductive layer 4.

The method of manufacturing the resistor 11 according to the embodiment is characterized by the manufacturing process wherein the thermally conductive layer 4 is initially semi-hardened (semi-cured), followed by bending the electrode plates 3 and thereafter further hardening (curing) the thermally conductive layer 4.

The above-described manufacturing process allows for suppression of variations in the thickness of the thermally conductive layer 4 between the resistive body 2 and the electrode plates 3 in comparison with background art process. That is, upon bending the electrode plates 3 and execution of the heating process, the thermally conductive layer 4 is in the semi-hardened (semi-cured) state, that is, it is not unhardened (uncured), but not completely hardened (cured). It is therefore possible to reduce the thickness variations in the thermally conductive layer 4 owing to fluidity thereof to be less than the case where the entire thermally conductive layer between the resistive body 2 and the electrode plates 3 is in the unhardened (uncured) state.

As described above, in the embodiment, the capability to suppress variations in the thickness of the thermally conductive layer 4 between the resistive body 2 and the electrode plates 3 makes it possible to make the thickness between the resistive body 2 and the electrode plates 3 further uniform, and to suppress variations in the heat dissipation property, thereby enabling manufacturing of the resistor 11 with excellent heat dissipation property. The further uniform thickness between the resistive body 2 and the electrode plates 3 may suppress generation of a gap or the like between the resistive body 2 and the electrode plates 3, resulting in improved adhesive, bonding strength therebetween.

An unhardened (uncured) and solidified material, specifically, a thermally conductive resin film may be preferably used for forming the thermally conductive layer 4.

When using an unhardened (uncured) and unsolidified material, specifically, a thermally conductive resin paste for forming the thermally conductive layer 4, the thickness of the thermally conductive layer in the applied state is likely to vary. The use of the thermally conductive resin film in the unhardened (uncured) and solidified state for forming the thermally conductive layer 4 allows for a better controlled, more uniform thickness between the resistive body 2 and the electrode plates 3.

In the step depicted in FIGS. 5A, 5B, and 5C, it is preferable to harden or cure the thermally conductive layer 4 while pressing the bent electrode plates 3. Such a procedure makes it possible to securely adhere the electrode plates 3.

EXAMPLE

The present invention will be described in more detail based on an example implemented to exhibit the advantageous effect of the present invention. However, the present invention is not limited to the example as described below.

In an experiment, the following resin was used, and the thermal analysis was carried out using a differential scanning calorimeter (DSC).

[Resin]

Polyimide/epoxy resin

[Differential Scanning Calorimeter]

DSC8231 manufactured by Rigaku Corporation

The DSC curve and the DDSC curve were obtained at the temperature elevation rate of 10° C./min in the experiment.

Figure 8:
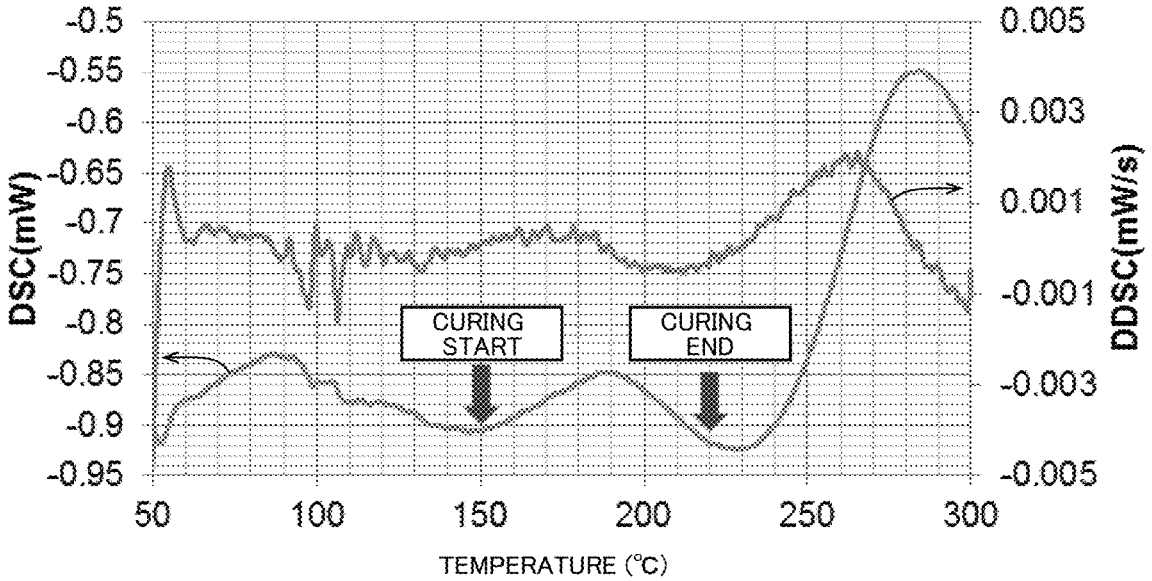
FIG. 8 is a graph showing a DSC curve and a DDSC curve of a polyimide/epoxy resin.

As FIG. 8 shows, the curing (hardening) start temperature was 150° C., and the curing (hardening) end temperature was 220° C. At the timing when the temperature reached 230° C. onward, transition of the phase to the combustion reaction was observed.

In accordance with the experimental result, the applied temperature was determined to be in the range from 160° C. to 220° C.

Next, the temperature was fixed to 170° C. to obtain the curing (hardening) start temperature and the curing (hardening) end temperature from the DSC curve in accordance with the holding time. The obtained experimental results are shown in FIG. 9.

Figure 9:
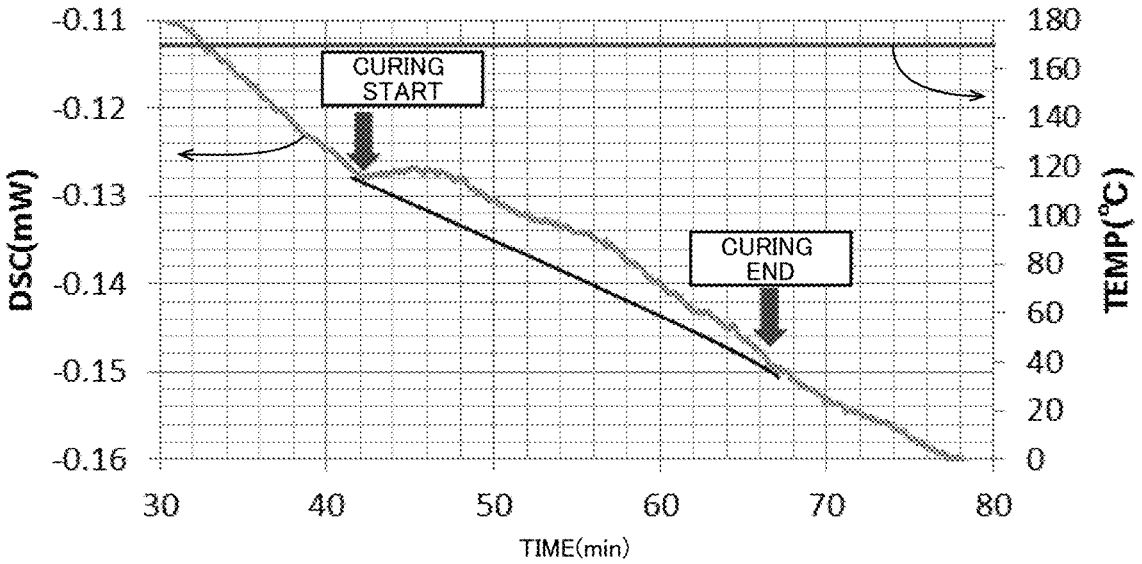
FIG. 9 is a graph showing a DSC curve of the polyimide/epoxy resin at a temperature fixed to 170° C.

FIG. 9 shows that the curing (hardening) started after a lapse of about 42 minutes, and the curing (hardening) ended after a lapse of about 61 minutes.

The above-described experimental results have clarified that the curing (hardening) condition of 170° C. for approximately 60 minutes is required when using the resin specified above. This curing (hardening) condition coincided with the curing condition recommended by the manufacturer of the resin.

As the curing (hardening) condition is established at 170° C. for 60 minutes, the curing (hardening) condition in the temperature range as shown in FIG. 8 may be established at 160° C. for 70 minutes, 170° C. for 60 minutes, 180° C. for 50 minutes, 190° C. for 40 minutes, and 200° C. for 30 minutes approximately.

It is considered that the semi-curing (semi-hardening) condition is established by setting the application time to be in the range from approximately 10% to 50% of the above described condition while keeping the temperature unchanged. Accordingly, at the application temperature of 170° C., the application time may be set to approximately 6 to 30 minutes.

INDUSTRIAL APPLICABILITY

The resistor according to the present invention exhibits excellent heat dissipation property while allowing a reduction in the height. The resistor may be surface-mounted so as to be mounted to various types of circuit boards.

The present application claims priority from Japanese Patent Application No. JP2017-237821 filed on Dec. 12, 2017, the content of which is hereby incorporated by reference into this application.

The invention claimed is:

1. A method for manufacturing a resistor, the method comprising:

a step of applying an unhardened and solidified thermally conductive layer onto a surface of a resistive body, the unhardened and solidified thermally conductive layer being a thermally conductive resin film;

a step of bringing the thermally conductive resin film into a semi-hardened state; and a step of bending electrode plates respectively disposed at both sides of the resistive body, further hardening the thermally conductive resin film while the bent electrode plates are in contact with the thermally conductive resin film, and performing adhesion between the resistive body and the electrode plates via the thermally conductive resin film.

2. The method for manufacturing a resistor according to claim 1, wherein the thermally conductive layer is further hardened while pressure is applied to the bent electrode plates.

* * * * *